US006463868B1

(12) United States Patent
Williams et al.

(10) Patent No.: US 6,463,868 B1
(45) Date of Patent: Oct. 15, 2002

(54) TETHER RETRACTION DEVICE

(75) Inventors: Michael R. Williams, West Kingstown, RI (US); Michael A. Bergeron, Coventry, RI (US); Kimberly M. Cipolla, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/922,312

(22) Filed: Jul. 30, 2001

(51) Int. Cl.[7] ..... B63B 21/56

(52) U.S. Cl. ..... 114/242; 114/254; 114/244; 242/375.3

(58) Field of Search ..... 114/242, 244, 114/247, 253, 254; 244/1 TD; 242/375, 375.1, 375.2, 375.3, 388, 388.6, 388.9, 388.91; 254/277

(56) References Cited

U.S. PATENT DOCUMENTS 2,915,259 A * 12/1959 Force ..... 242/379
2,956,532 A * 10/1960 James et al. ..... 114/254
3,159,806 A * 12/1964 Piasecki ..... 367/106
3,242,895 A * 3/1966 Hornby ..... 114/254
3,298,347 A * 1/1967 Swain et al. ..... 114/244
3,326,493 A * 6/1967 Bondesen, Jr. et al. .. 242/375.3
3,547,371 A * 12/1970 Gruseck ..... 242/377
3,645,468 A * 2/1972 Edelberg et al. ..... 242/372
3,657,491 A * 4/1972 Ryder et al. ..... 191/12.2 R
3,817,472 A * 6/1974 Abe ..... 242/375.3
3,929,210 A * 12/1975 Cutler et al. ..... 191/12.2 R
4,290,564 A * 9/1981 Karlsson ..... 242/375.3
4,407,460 A * 10/1983 Khudaverdian ..... 242/372
5,119,751 A * 6/1992 Wood ..... 114/242
5,263,431 A * 11/1993 Wood ..... 114/254
5,409,176 A * 4/1995 Kopetzky ..... 242/375.3
5,628,470 A * 5/1997 Ray et al. ..... 242/375.3

* cited by examiner

*Primary Examiner*—S. Joseph Morano
*Assistant Examiner*—Ajay Vasudeva
(74) *Attorney, Agent, or Firm*—Michael J. McGowan; James M. Kasischke; Michael F. Oglo

(57) ABSTRACT

The present invention relates to a tether retraction device having particular utility with multi-line towed arrays. A system for retrieving and deploying a multi-line towed array having a plurality of array lines has at least one tether joinable between two of the plurality of array lines. A tether retraction device is incorporated into at least one of the array lines for retracting the tether. Each tether retraction device has a tether take-up spool, and a spring driven drive means which causes the tether to wind onto the take-up spool when the array is towed at slow speeds and allows deployment of the tether from the take-up spool when tension in the tether caused by tow forces exceeds the spring force applied by the spring driven drive means.

15 Claims, 2 Drawing Sheets

TETHER RETRACTION DEVICE

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED PATENT APPLICATIONS

Not applicable.

BACKGROUND OF THE INVENTION (1) Field of the Invention

The present invention pertains to a tether retraction device which nests or holds together a plurality of individual lines in a multi-line towed array allowing for safe and reliable storage, deployment, and operation.

(2) Description of the Prior Art

Tow lines are used in a variety of different applications. For example, U.S. Pat. No. 2,956,532 to James et al. illustrates a seaplane towing line and U.S. Pat. No. 3,159,806 to Piasecki illustrates a high speed tow sonar system including a paravane with a reel for letting in or letting out the tow line for a satellite carrier.

U.S. Pat. No. 3,298,347 to Swain et al. illustrates a submersible towing apparatus with a reversibly drivable reel. U.S. Pat. No. 4,407,460 to Khudaverdian illustrates a tow rope for a water skier having a spring loaded reel.

U.S. Pat. No. 5,119,751 to Wood illustrates a vertical stabilizer installed towed array handling system in which a vertical stabilizer is provided with a chamber in which is rotatably mounted a reel for rotation about an athwartship axis. One of the side elements of the reel has an engageable surface adjacent its periphery. A drive motor in the stabilizer is engaged with the engageable surface of the one side element to effect rotation of the reel. An elongated cable is coiled about the hub of the reel and extends outwardly of a passage extending to the aft end of the stabilizer. A mechanism inside the vertical stabilizer guides the cable between the passage and the storage space to facilitate coiling of the cable onto the reel and for deploying the cable therefrom. A brake mechanism is used to prevent the reel against rotation to prevent further either deploying or coiling of the cable.

U.S. Pat. No. 5,263,431 to Wood illustrates a combination winch and stowage reel assembly for arrays towed by submarines. The assembly comprises a hub, a slip ring mounted in the hub and in communication with a receiver in the submarine, a reel rotatably mounted on the hub, the reel having gear teeth on a periphery thereof, a tow cable fixed to the reel and adapted to have attached to a free end thereof an array to be towed behind the submarine, the tow cable being in communication with the slip ring to form a communication path including the array, the tow cable, the slip ring, and the receiver, a drive gear engaged with the reel gear teeth, and a motor for turning the drive gear, thereby to turn the reel on the hub to pay out and take up the cable.

A significant problem in the design of a multi-line towed array is to provide a mechanism for reliably deploying and retrieving a system of lines while still providing a system which separates the lines during use to a pre-determined three-dimensional configuration. Often, a multi-line array is deployed and retrieved from a stowage tube (a long tube into which the array is pulled). Experimentation has shown that if the lines move independently of each other during deployment and retrieval, system performance can be compromised. The individual lines must be held together or nested to ensure proper deployment and retrieval performance. The nesting device must operate under the following constraints: (a) allow deployment and retrieval of the multi-line array and proper operation of the system; (b) operate in a seawater environment with an operating pressure of 1000 psi and a survival pressure of 2500 psi; (c) maintain performance for a minimum of one year without maintenance in a submarine environment; (d) operate automatically with neither power nor outside intervention; (e) be compatible with packaging in a 1 inch diameter and a maximum rigid length of six inches; and (f) provide a maximal retraction force in the nested position and a minimum retraction force at the fully extended position.

Currently, there are no existing apparatus or methods to nest the individual lines in a multi-line array.

SUMMARY OF THE INVENTION

Accordingly, it is an object of the present invention to provide a tether retraction device which holds or nests individual lines of a multi-line array together during deployment and retrieval.

It is a further object of the present invention to provide a tether retraction device as above which requires no operator activation or intervention.

It is another object of the present invention to provide a tether retraction device as above which provides maximal retraction forces in the nested position and minimal retraction forces at the fully extended position.

It is yet another object of the present invention to provide a tether retraction device as above which has no impact on the performance of a towed array.

The foregoing objects are attained by the tether retraction device of the present invention.

In accordance with the present invention, a tether retraction device for use with a multi-line towed array is provided. The present invention relates to a tether retraction device having particular utility with multi-line towed arrays. A system for retrieving and deploying a multi-line towed array having a plurality of array lines has at least one tether joinable between two of the plurality of array lines. A tether retraction device is incorporated into at least one of the array lines for retracting the tether. The tether retraction device has a tether take-up spool, and a spring driven drive means which causes the tether to wind onto the take-up spool when the array is towed at slow speeds and allows deployment of the tether from the take-up spool when tension in the tether caused by tow forces exceeds the spring force applied by the spring driven drive means. In further detail the invention provides that through a series of take up spools the spring driven drive provides a maximum retraction force in the retracted position and a minimum retraction force in the deployed position.

Other details of the tether retraction device of the present invention, as well as other objects and advantages attendant thereto, are set forth in the following detailed description and the accompanying drawings in which like reference numerals depict like elements.

DESCRIPTION OF THE PREFERRED EMBODIMENT(S)

Figure 1:
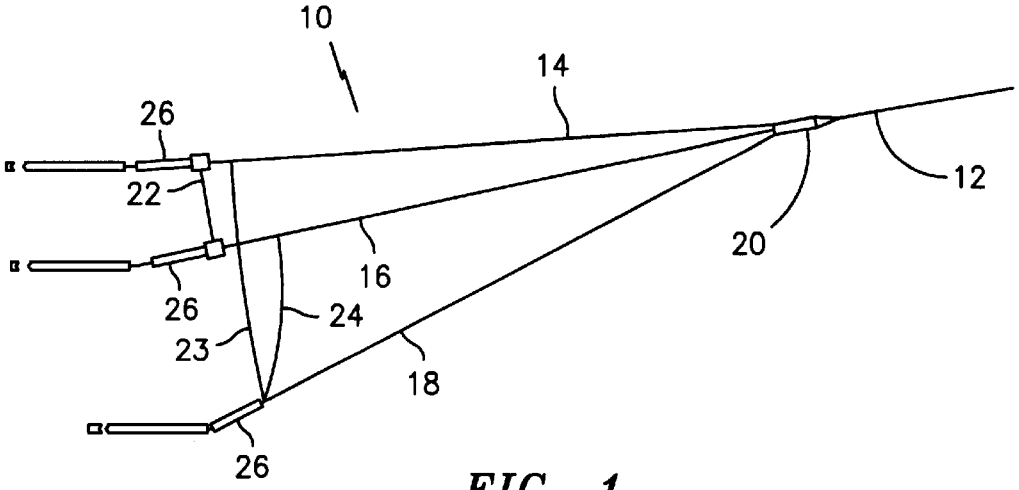
FIG. 1 is a schematic representation of a multi-line array configuration.

Referring now to the drawings, FIG. 1 illustrates a towed multi-line array system 10 having a tow cable 12, array lines 14, 16, and 18, and a tri-joint 20 connecting the array lines 14, 16, and 18 to the tow cable 12. The system 10 further has a main tether 22 connecting lines 14 and 16 and lower tethers 23 and 24 connecting lines 14 and 18 and lines 16 and 18, respectively. The system 10 also includes a tether retraction device 26 incorporated into at least one of the lines 14, 16, and 18, and preferably into each of the lines 14, 16, and 18.

In accordance with the present invention, the tether retraction device 26 consists of a series of spools driven by a constant tension spring system. The system of spools used in the tether retraction device 26 minimizes the required spring travel and changes the force output on the tether, thereby reducing the rigid length of device 26.

Figure 3:
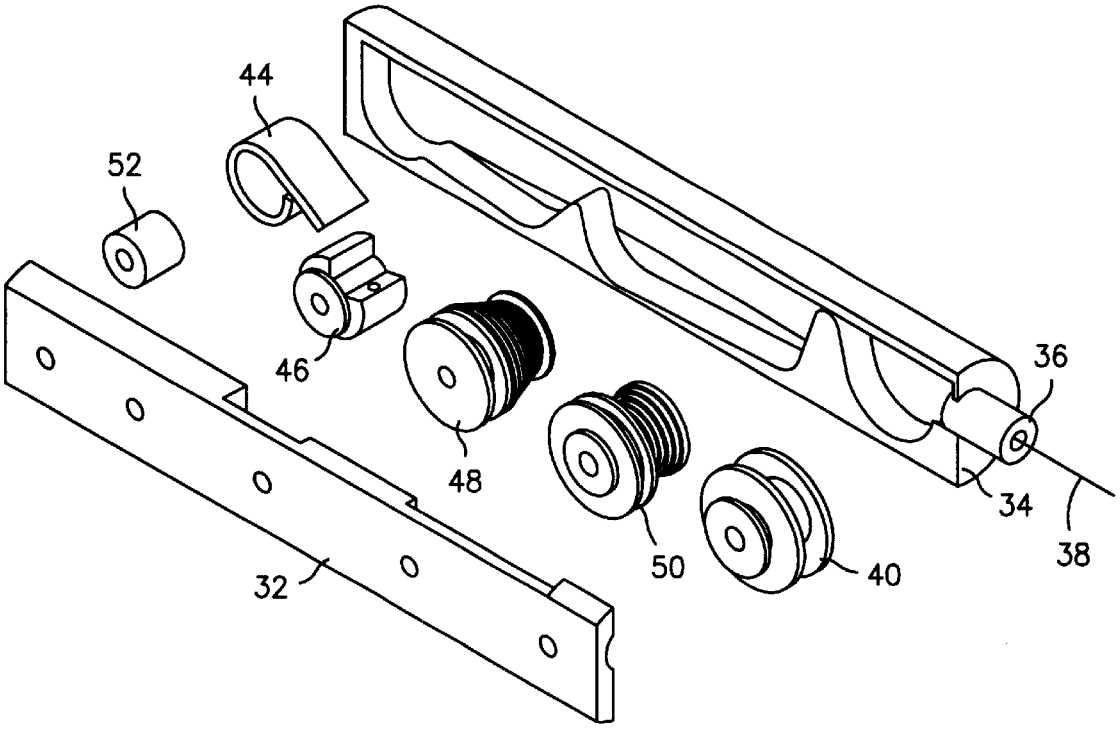
FIG. 3 is an exploded view of the tether retraction device of FIG. 3.
Figure 2:
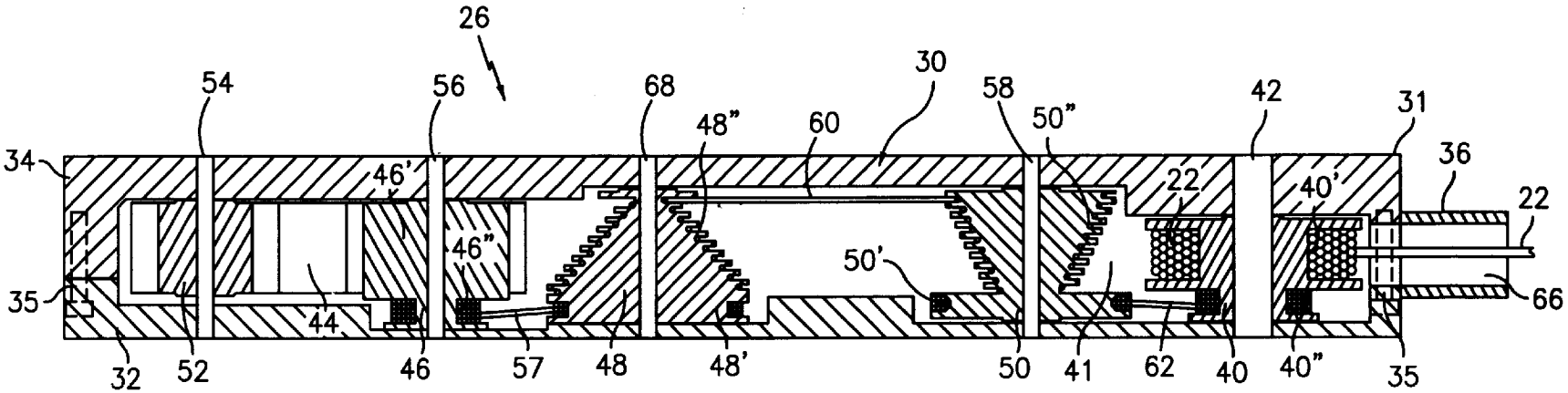
FIG. 2 is a cut away view of a tether retraction device in accordance with the present invention.
Figure 4:
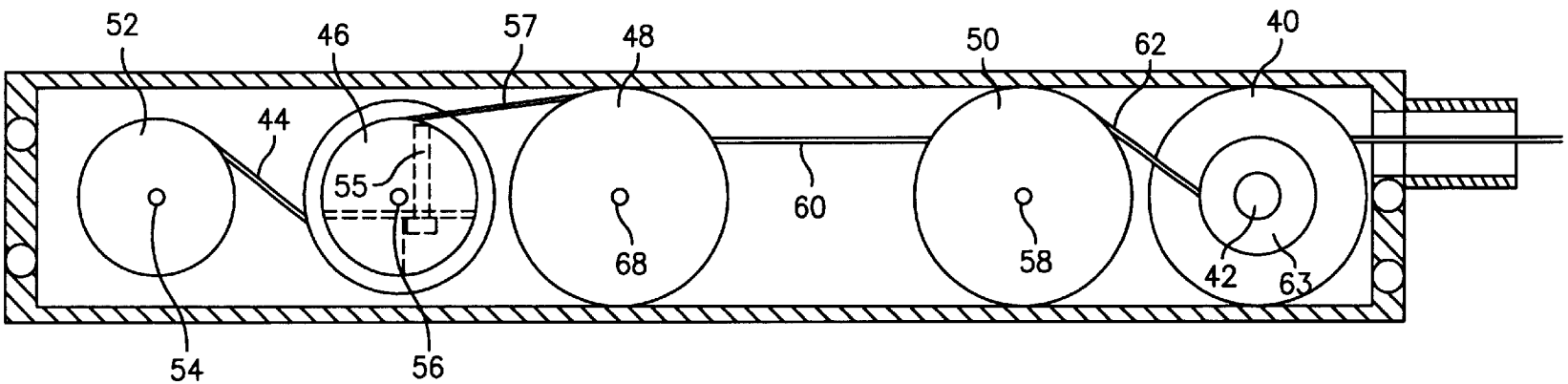
FIG. 4 is a cut away view of the tether retraction device of FIG. 3.

Referring now to FIGS. 2–4, the tether retraction device 26 of the present invention has a housing 30 which is formed by first and second brackets 32 and 34. The brackets 32 and 34 may be joined together in any suitable manner known in the art such as by a plurality of screws and alignment pins 35 as shown in FIG. 2. As shown in FIG. 2, the bracket 34 could have a stepped interior surface with a plurality of annular grooves for receiving drive system components, while the bracket 32 may have a substantially planar interior surface with a plurality of matching annular grooves for the drive system components. A guide tube 36 is provided at one end of the housing 30 and extends through a sidewall 31 of the housing 30. Guide tube 36 may be joined to one or both of the brackets 32 and 34 using any suitable means known in the art. If desired, guide tube 36 may be integrally formed or cast with one of the brackets 32 and 34. Guide tube 36 aligns tether 22 with the workings of device 26.

The tether retraction device 26 includes a tether take-up spool 40. The spool 40 sits within an interior space 41 defined by the brackets 32 and 34. Tether take-up spool 40 is mounted to rotate about a first axis defined by a spindle 42. The spindle 42 can be seated in the brackets 32 and 34 in any desired manner known in the art. Tether take up spool 40 has a tether take up portion 40' and a third tension member spool portion 40". Tether take up portion 40' provides a location for winding tether 22 upon retraction. Likewise, third tension member spool portion 40" provides a location for winding third tension member 62 when tether 22 is retracted.

A spring driving force is applied to the spool 40 via a spring drive system. The spring drive system includes a constant tension spring 44, a spring take-up spool 46, a first gearing spool 48, and a second gearing spool 50. The constant tension spring 44 is positioned on a spring stowage spool 52 in which is mounted on a spindle 54 for rotation about a second axis parallel to the first axis. As best shown in FIG. 4, a free end of the spring 44 is preferably secured to the spring take-up spool 46 by a pin 55. As can be seen from FIGS. 2 and 4, the spring take-up spool 46 is connected to the first gearing spool 48 by a first tension member 57. The second gearing spool 50 is preferably mounted on a spindle 58 for rotation about an axis parallel to the axes of the spring stowage spool 52, the spring take up spool 46 and the first gearing spool 48. A driving engagement is preferably formed between the first gearing spool 48 and the second gearing spool 50 by winding a second tension member 60 about the first gearing spool 48 and the second gearing spool 50. Similarly, a driving engagement is formed between the second gearing spool 50 and the tether take-up spool 40 by winding a third tension member 62 about the second gearing spool 50 and third tension member spool 40" coaxial with and fixed to tether take-up spool 40. First, second and third tension members 57, 60, 62 can be any flexible member supporting tensile loading such as a wire, ribbon, or string. The tension members 57, 60 and 62 in the device 26 act as a gear train. While it is preferred to use a length of string or wire to form the drive train, other mechanisms could be used to create the drive train.

Spring take up spool 46 has a spring take up portion 46' and a first tension member retaining portion 46". Spring take up portion is adapted to receive the tension spring as the tether 22 is deployed. First tension member retaining portion 46" provides a location for winding first tension member 57 when tether 22 is deployed.

First gearing spool 48 has a first tension member spool portion 48' and a conical gearing portion 48". First tension member spool portion 48' provides a location for winding first tension member 57 when tether 22 is retracted. First tension member spool portion 48' is aligned with first tension retaining member 46" allowing efficient travel of first tension member 57. Conical gearing portion 48" is spirally threaded to retain second tension member 60 thereon at a radius dependent upon retraction or deployment of tether 22. Conical gearing portion 48" is mounted coaxially with first tension member spool portion 48' such that maximum force is provided in first tension member 57 when tether 22 is retracted.

Second gearing spool 50 has a third tension member spool portion 50' and a conical gearing portion 50". Third tension member spool portion 50' provides a location for winding third tension member 62 when tether 22 is deployed. Conical gearing portion 50" is spirally threaded to retain second tension member 60 thereon at a radius dependent upon retraction or deployment of tether 22. Conical gearing portion 50" is mounted coaxially with third tension member spool portion 50' such that maximum force is provided in first tension member 57 when tether 22 is retracted. Second conical gearing portion 50" is positioned to hold second tension member 60 at a position minimizing the axial deviation of the second tension member 60 between first conical gearing portion 48" and second conical gearing portion 50".

In order to facilitate the retrieval and deployment of the multi-line array, at least one of the tethers 22, 23, and 24 (identified hereinafter as 22) is attached to a tether take-up spool 40. The tether 22, for example, passes through a central aperture 66 in guide tube 36. Guide tube 36 helps insure the proper winding of the tether 22 on the spool 40. Tether 22 can also be joined to a smaller diameter lanyard for easier storage on spool 40.

In operation, when the tension in the tethers 22 is below the threshold of the force applied by the spring drive system, i.e., at slow tow speeds or during storage, the spool 40 automatically draws tether 22 into the device 26 the tether is wrapped onto the tether take-up spool 40 and stored. This holds the tether 22, and thereby its associated array line, in place until the forces produced by the components of the system 10 are great enough to overcome the force applied by the spring drive system. This condition occurs during deployment when the tow speed increases. When the force being applied to the tethers 22, 23 and 24 exceed the force applied by the spring drive system, the tether 22 is pulled off the spool 40. As can be seen from this description, this cycle of retraction and release advantageously occurs without power or intervention.

By providing a tether retraction device 26 which requires no operator activation or intervention, the complexity of the towed system is drastically reduced and its reliability is increased. The tether retraction device 26 is designed to be compatible with the specifications for towed array operations and survival and therefore has no impact on the multi-line array utilization. The geometry of the tether retraction device 26 is such that it has no impact on the towed array stowage tube or handling system.

The entire tether retraction device 26 of the present invention could be housed within a 1.45 inch diameter hose section. Thus, it has no impact on the array performance or self-noise.

By pulling the individual array lines together and holding them in a fixed orientation, the tether retraction device 26 of the present invention eliminates any independent movement of the lines in the towed array stowage tube.

The exit of the stowage tube is typically located in flow fields that may contain vortices or large vertical velocity components. Since the tether retraction device 26 of the present invention maintains the nested configuration as the array lines leave the stowage tube and pass through regions of adverse flow, thereby nesting the array lines until they enter the free stream, the tether retraction device 26 minimizes the risk of tangling during array deployment and retrieval.

By storing the tether(s) on spools that are housed inside a hose section, the tether retraction device 26 protects these small diameter lines from exposure to slag or other imperfections on the inside wall of the stowage tube that could degrade their service life or break them.

It is apparent that there has been provided in accordance with the present invention a tether retraction device which fully satisfies the objects, means, and advantages set forth hereinbefore. While the present invention has been described in the context of specific embodiments thereof, other alternatives, modifications, and variations will become apparent to those skilled in the art having read the foregoing description. Therefore, it is intended to embrace those alternatives, modifications, and variations as fall within the broad scope of the appended claims.

What is claimed is:

1. A retraction device for use with a tether comprising:

a housing;

a constant tension spring affixed to said housing;

a spring take-up spool rotatably joined to said housing, joined to said constant tension spring and having a member storage portion, rotation of said spring take-up spool causing tension in said constant tension spring;

a first gearing spool rotatably positioned in said housing and having a member storage portion and a gearing portion;

a first tension member joined between said first gearing spool member storage portion and said spring take-up spool member storage portion and windable thereon;

a second tension member joined to said first gearing spool gearing portion and windable thereon;

a second gearing spool rotatably positioned in said housing and having a member storage portion and a gearing portion, said second tension member being joined to said second gearing spool gearing portion and windable thereon;

a third tension member joined to said second gearing spool member storage portion; and a tether take-up spool having a tether storage portion and a member storage portion and rotatably positioned in said housing, said tether take-up spool member storage portion joined to be rotated by said third tension member and said tether take-up spool tether storage portion being joined to said tether.

2. A retraction device according to claim 1 wherein said spring take-up spool, first gearing spool, said second gearing spool, and said tether take-up spool rotate about parallel axes.

3. A retraction device according to claim 2 wherein said first tension member, said second tension member and said third tension member are each selected from a group consisting of a string, a wire and a ribbon.

4. A retraction device according to claim 2 further comprising a guide tube connected to said housing and communicating with said tether take-up spool for aligning said tether on said tether take-up spool.

5. A retraction device according to claim 1 wherein:

said first gearing spool gearing portion is conically shaped for providing different radii depending on the amount of said second tension member wound thereon; and said second gearing spool gearing portion is conically shaped for providing different radii depending on the amount of said second tension member wound thereon.

6. A retraction device according to claim 5 wherein said first and second gearing spool gearing portions have retaining members for retaining tension members wound thereon.

7. A retraction device according to claim 6 further comprising a guide tube connected to said housing and communicating with said tether take-up spool for aligning said tether on said tether take-up spool.

8. A retraction device according to claim 1 further comprising a spring stowage spool joined to said housing, said constant tension spring being fixed to said spring stowage spool for stowing said constant tension spring when said tether is retracted.

9. A system for retrieving and deploying a multi-line towed array having a plurality of array lines comprising:

at least one tether joinable between two of said plurality of array lines; and a tether retraction device incorporated into at least one of said array lines and joined for retracting said at least one tether, each said tether retraction device comprising a tether take-up spool, and a spring driven drive means for causing said tether to wind onto said tether take-up spool when said array is towed at slow speeds and for allowing said tether to deploy from said tether take-up spool when tension in said at least one tether caused by towing said array exceeds a force applied by said spring driven drive means to said tether take-up spool.

10. The system of claim 9 wherein said tether retraction device further comprises:

a housing configured as part of said incorporated array line;

said spring driven drive means comprising:

a constant tension spring affixed to said housing;

a spring take-up spool rotatably joined to said housing, joined to said constant tension spring and having a member storage portion, rotation of said spring take-up spool causing tension in said constant tension spring;

a first gearing spool rotatably positioned in said housing and having a member storage portion and a gearing portion;

a first tension member joined between said first gearing spool member storage portion and said spring take-up spool member storage portion and windable thereon;

a second tension member joined to said first gearing spool gearing portion and windable thereon;

a second gearing spool rotatably positioned in said housing and having a member storage portion and a gearing portion, said second tension member being joined to said second gearing spool gearing portion and windable thereon;

a third tension member joined to said second gearing spool member storage portion; and said tether take-up spool having a tether storage portion and a member storage portion and rotatably positioned in said housing, said tether take-up spool member storage portion joined to be rotated by said third tension member and said tether take-up spool tether storage portion being joined to said tether.

11. A retraction device according to claim 10 wherein:

said first gearing spool gearing portion is conically shaped for providing different radii depending on the amount of said second tension member wound thereon; and said second gearing spool gearing portion is conically shaped for providing different radii depending on the amount of said second tension member wound thereon.

12. A retraction device according to claim 11 wherein said first and second gearing spool gearing portions have retaining members for retaining tension members wound thereon.

13. A retraction device according to claim 12 further comprising a guide tube connected to said housing and communicating with said tether take-up spool for aligning said tether on said tether take-up spool.

14. A retraction device according to claim 10 further comprising a spring stowage spool joined to said housing, said constant tension spring being fixed to said spring stowage spool for stowing said constant tension spring when said tether is retracted.

15. The system of claim 9 wherein each said at least one tether has a tether retraction system.

* * * * *